US008446396B2

(12) United States Patent
Lai et al.

(10) Patent No.: US 8,446,396 B2
(45) Date of Patent: May 21, 2013

(54) BI-STABLE DISPLAY, FRAME UPDATING METHOD AND TIMING CONTROL METHOD THEREOF

(75) Inventors: Rui-Yang Lai, Hsinchu (TW); Po-Sen Chen, Hsinchu (TW); Hua-Chien Hung, Hsinchu (TW); Kui-Hao Chang, Hsinchu (TW)

(73) Assignee: E Ink Holdings Inc., Hsinchu County (TW)

( * ) Notice: Subject to any disclaimer, the term of this patent is extended or adjusted under 35 U.S.C. 154(b) by 427 days.

(21) Appl. No.: 12/757,950

(22) Filed: Apr. 9, 2010

(65) Prior Publication Data

US 2010/0271360 A1 Oct. 28, 2010

(30) Foreign Application Priority Data

Apr. 24, 2009 (TW) ..... 98113809 A

(51) Int. Cl.
*G09G 5/00* (2006.01)

(52) U.S. Cl.
USPC ..... 345/210; 345/107

(58) Field of Classification Search
USPC ..... 345/107, 84, 210, 87, 94, 211
See application file for complete search history.

(56) References Cited

U.S. PATENT DOCUMENTS

2006/0262083 A1* 11/2006 Zhou et al. ..... 345/107
2008/0018589 A1* 1/2008 Shih ..... 345/107
2009/0015546 A1* 1/2009 Choi et al. ..... 345/107

FOREIGN PATENT DOCUMENTS

CN 101192386 A 6/2008

OTHER PUBLICATIONS

China Official Action issued on May 3, 2012.

* cited by examiner

*Primary Examiner* — Chanh Nguyen
*Assistant Examiner* — Allison Walthall
(74) *Attorney, Agent, or Firm* — Chun-Ming Shih

(57) ABSTRACT

A bi-stable display, frame updating method and timing sequence controlling method thereof are disclosed. The frame updating method of the bi-stable display includes the steps of comparing a difference of source driver output voltages of adjacent frames of image updating period with a preset threshold, and determining parameter value of each transitional state of the adjacent frames when the difference equal or greater than the preset threshold for controlling level of source driver output voltage. Accordingly, the effects such as signal interference, reduction of image quality resulted from switching between high voltage levels directly and rapidly and excessive power consumption may be eliminated.

9 Claims, 6 Drawing Sheets

BI-STABLE DISPLAY, FRAME UPDATING METHOD AND TIMING CONTROL METHOD THEREOF

CROSS-REFERENCE TO RELATED APPLICATIONS

This application is based upon and claims the benefit of priority from the prior Taiwan Patent Application No. 098113809, filed Apr. 24, 2009, the entire contents of which are incorporated herein by reference.

BACKGROUND

The present invention relates to a display device and control method thereof. More particularly, the present invention relates to a bi-stable display, a frame updating method and a timing control method.

The bi-stable display technic is a common name of a display technic. Hitherto, cholesterol display technic and electronic ink display technic are the most known. In the bi-stable display technic, for example, the electrophoresis display, an on/off action of the display can be implemented by a motion of the charge particle, and its timing controller is connected to a microprocessor of the system which can drive the electrophoresis display through a drive chip after receiving command order and image data. Furthermore, the bi-stable can still have two different states (bright state and dark state) without voltage and maintain continuously. Therefore, the image can be held on the display without voltage and reduce power consumption effectively. Widely speaking, bi-stable display technic is growing with more and more displaying gray scale/color depth, i.e. multi-stable display technic. In contrast with the prior art pure liquid crystal display technic, the bi-stable technic with the frame memory function does not need the backlight so that it can save several hundred times of the power consumption and become thinker and lighter. This characteristic can extend life of a battery of a portable device, for example, mobile phone, electronic book, electronic newspaper and electronic tag, and even large electronic bulletin board.

In drive of the bi-stable display, for example, the electrophoresis display, the drive method is similar with the pulse width modulation (PWM). The corresponding impulse provided to the electrophoresis display by the source driver is controlled by a timing controller. The normal source drive voltage levels are positive voltage (VPOS), negative voltage (VNEG) and 0 volt (GND) respectively. The positive and negative voltage is depend on material of the electrophoresis display, and some material need to be provided higher voltage for changing the gray scale of images in unit time effectively. Please refer to FIG. 1, it is a schematic diagram of the conventional source drive output voltage of the bi-stable display during image updating period. As shown in FIG. 1, the image updating period has frames $F_1$~$F_8$. The positive and negative high voltage levels $V_1$ and $V_2$ (not shown) of the adjacent frames $F_1$ and $F_2$ are (+15) and (−15) volt respectively, and there is a voltage level with 0 volt. As shown in FIG. 1, the source drive output voltages of the adjacent frames $F_3$ and $F_4$ are switched directly at high voltage level $V_2$ and $V_1$, and the source drive output voltages of $F_1$ and $F_2$ are switched directly to $V_1$ from $V_2$. In updating frame, the drive method of the gray scale of each pixel is determined by the last frame, the next frame, and the environment temperature. Therefore, the present drive method are usually switched directly at high voltage level which belongs high voltage difference and fast voltage transfer. Therefore, other signals have enormous noise coupling so that the frame appears image unstable, un-uniformity, ghosting, crosstalk and over power consumption easily.

BRIEF SUMMARY

The present invention relates to a bi-stable display frame updating method which can reduction of image quality resulted from switching between high voltage levels directly and rapidly, eliminate signal interference and excessive power consumption.

The present invention relates to a bi-stable display which can avoid switching between high voltage levels directly and store relational parameter value in a memory unit for driving display control.

The present invention relates to a timing control method of bi-stable display which can be determined by a threshold mechanism and store relational parameter value in a memory unit for arrangement and control of drive display timing.

In one aspect of the present invention, a frame updating method of the bi-stable display is provided. The method includes the steps of comparing a difference of source driver output voltages between the adjacent frames with a preset threshold in the image updating period, and a parameter value of each transitional state between the adjacent frames is determined by that the difference is equal or greater than the preset threshold for controlling level of the source driver output voltage.

In an embodiment of the present invention, the transitional state of the frame updating method of the bi-stable display can be a transitional state frame located between the adjacent frames. The parameter value can be a number of the transitional state or a value of the source driver output voltage corresponding to the transitional state. In other words, the frame by frame method is used to update a gray scale value of pixels when a timing controller of the present bi-stable display (for example, electrophoresis display) updates the frames so that the frame can be a unit for the transitional state, i.e. a blank frame is added to be a transitional state frame that the transitional state is located. In an embodiment of the present invention, the transitional state can be a dummy line located between the adjacent frames, i.e. a blank line is added behind an active scan line of each frame and its parameter value comprises a value of the source drive output voltage corresponding to the dummy line. Besides, the frame updating method of the bi-stable display further includes the step of storing the parameter value of the transitional state in a memory unit for controlling the source drive output voltages after reading. Wherein, the memory unit is disposed on a bi-stable display panel, a drive control circuit board, or a middle interface circuit board.

In one aspect of the present invention, a bi-stable display is provided. The bi-stable display includes a bi-stable display panel, a drive control circuit board, a middle interface circuit board and a memory unit. The drive control circuit board includes a middle interface circuit board connector, a control chip, a panel power module, a system power supply module and a microprocessor. The middle interface circuit board is coupled to the middle interface circuit board connector. The material of the middle interface circuit board is normally flexible printed circuit. The memory unit for storing a parameter value of a transitional state is read by the display timing controller. Wherein, the parameter value is determined by a comparing result of comparing a difference of source driver output voltages between the adjacent frames with a preset threshold voltage in the image updating period.

In an embodiment of the present invention, the memory unit of the bi-stable display is disposed on the bi-stable display panel, the drive control circuit board, or the middle interface circuit board, and the parameter value is a number of a transitional state, a value of the source driver output voltage or a value of a dummy line voltage.

In one aspect of the present invention, a timing control method of the bi-stable display is provided. The method includes the steps of comparing a difference of source driver output voltages between the adjacent frames with a preset threshold in the image updating period, and adding a transitional state at least when the difference is equal or greater than the preset threshold.

In an embodiment of the present invention, the transitional state can be located at a dummy line behind an active scan line of each of the adjacent frames or between the adjacent frames. Besides, the method further includes the step of storing a number of the transitional state or a voltage value of the transitional state in a memory unit for reading.

The blank frame or the dummy line is added to form the bi-stable display, frame updating method and timing control method of the present invention. Therefore, the levels of the source drive output voltages are changed in sequence by decreasing or increasing to eliminate signal interference, reduction of image quality and excessive power consumption resulted from switching between high voltage levels directly and rapidly.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 2:
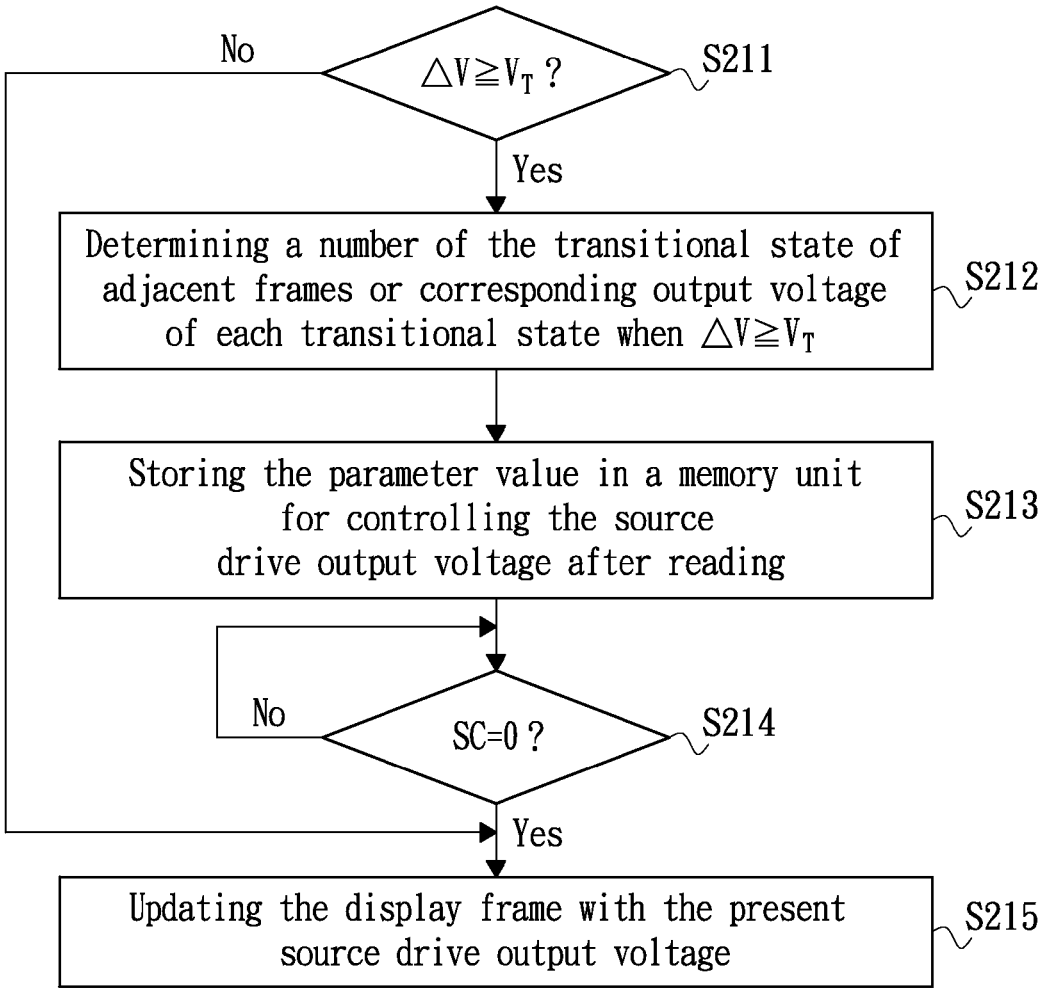
FIG. 2 is a flow chart diagram of an embodiment of the frame updating method of the bi-stable display according to the invention.

FIG. 2 shows a flow chart diagram of an embodiment of the frame updating method of the bi-stable display according to the invention. In step S211, a difference $\Delta V$(it's $|V_1-V_2|$) of source driver output voltages between the adjacent frames are compared with a preset threshold voltage $V_T$ during an image updating period, i.e. the $\Delta V$ equal or greater than the $V_T$ is compared to determine whether switch amplitude of the voltage level is greater than the threshold voltage. In actual practice, the source driver output voltage and the threshold voltage can be recorded by using binary values, for example, 00 is presented as 0 volt, 01 is presented as (−15) volt, and 10 is presented as 15 volt. Therefore, the difference $\Delta V$ is the comparing result of the source driver output voltages with the preset threshold voltage $V_T$ in the step S211, in fact it is equal to compare the difference of the preset binary values or the difference of the calculated source driver output voltages corresponding to the preset binary values with the preset threshold voltage.

In the present invention, when the difference $\Delta V$ of the source driver output voltages is equal or greater than the preset threshold voltage $V_T$, a parameter value of each transitional state between the adjacent frames is determined for controlling the level of the source driver output voltage in step S212. The parameter value can be a number of the transitional state or a value of the source driver output voltage corresponding to the transitional state and used to assign the difference $\Delta V$ of the source driver output voltages. In other words, in the step S212, the number of the transitional state or a value of the source driver output voltage corresponding to the transitional state is determined, set the transitional state number counter SC of the countdown parameter and conditions of performing preset drive method is also determined. In the present invention, the parameter value will be a number of the transitional state or a value of the source driver output voltage corresponding to the transitional state if the transitional state is a transitional state frame between the adjacent frames. The parameter value will comprise a value of the source drive output voltage corresponding to the dummy line if the transitional state is the dummy line behind the active scan line of each of the adjacent frames. Then, the parameter value of the transitional state is stored in a memory unit for controlling the source drive output voltages after reading. The memory unit is disposed on the bi-stable display panel, the drive control circuit board, or the middle interface circuit board which is Flexible Printed Circuit normally, and the middle interface circuit board is coupled to the drive control circuit board. In another way, in the step S211, if the difference $\Delta V$ of the source driver output voltages is smaller than the preset threshold voltage $V_T$ or a content of the transitional state number counter SC is decreased to 0 (i.e. SC=0) in step S214, the preset drive method is preformed without adjusting the level of the source drive output voltage, i.e. the bi-stable display frame is updated with the preset source drive output voltage of the adjacent frames.

Figure 1:
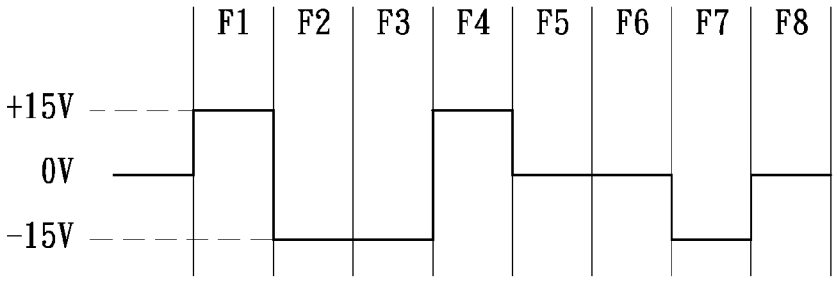
FIG. 1 (Prior Art)
FIG. 1 is a schematic diagram of the conventional source drive output voltage of the bi-stable display during image updating period.
Figure 3:
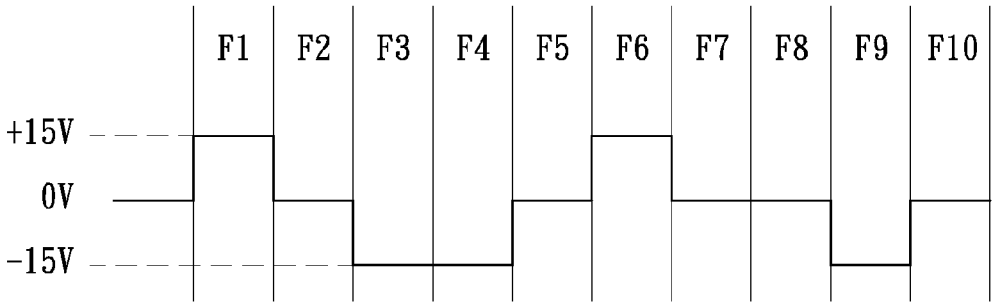
FIG. 3 is a schematic diagram of an embodiment of the source drive output voltage of the bi-stable display during an image updating period according to the invention.

For comparison description, please refer to FIG. 1 and FIG. 3, wherein FIG. 1 is a schematic diagram of the conventional source drive output voltage of the bi-stable display during image updating period, and FIG. 3 is a schematic diagram of an embodiment of the source drive output voltage of the bi-stable display during an image updating period according to the invention. As shown in FIG. 3, the positive and negative high voltage levels $V_1$ and $V_2$ (not shown) of the adjacent frames $F_1$ and $F_2$ of FIG. 1 are (+15) and (−15) volt respectively and the preset threshold voltage $V_T$ (not shown) is 20 volt. Therefore, the difference of the source drive output voltage $\Delta V$ is 30 volt and greater than the preset threshold voltage $V_T$ so that the source drive output voltages are (+15), 0, and (−15) volt sequentially if the number of the transitional state and the content of the transitional state number counter SC are set to 1. That means a transitional state with 1 of the transitional state frame is located between the adjacent frames $F_1$ and $F_2$ of FIG. 1 so that positive and negative high voltage levels of the difference equal or greater than preset threshold voltage can not be switched directly without bad interference. Therefore, this image updating is finished in the frames $F_1$ to $F_3$ in FIG. 3. In other embodiment, the corresponding source drive output voltages are (+15), (+5), (−5), and (−15) volt if the number of the transitional state is 2, and so on.

Please refer to FIG. 3 again, the positive and negative high voltage levels $V_1$ and $V_2$ (not shown) of the adjacent frames $F_3$ and $F_4$ of FIG. 1 are (+15) and (−15) volt respectively. Therefore, the difference of the source drive output voltage ΔV is 30 volt and greater than the preset threshold voltage $V_T$ with 20 volt so that the corresponding source drive output voltages are (+15), 0, and (−15) volt sequentially if the number of the transitional state and the content of the transitional state number counter SC are set to 1. That means a transitional state of the transitional state frame is located between the adjacent frames $F_3$ and $F_4$ of FIG. 1 so that positive and negative high voltage levels of the difference equal or greater than preset threshold voltage can not be switched directly without bad interference. Therefore, this image updating is finished in the frames $F_4$ to $F_6$ in FIG. 3. Secondly, the positive and negative high voltage levels $V_1$ and $V_2$ (not shown) of the adjacent frames $F_5$ and $F_6$ of FIG. 1 are both 0 volt. Therefore, the difference of the source drive output voltage ΔV is 0 volt and smaller than the preset threshold voltage $V_T$ with 20 volt so that the bi-stable display frame is updated with 0 volt of the preset source drive output voltage at the frames $F_7$ to $F_8$ in FIG. 3. Then, the positive and negative high voltage levels $V_1$ and $V_2$ (not shown) of the adjacent frames $F_7$ and $F_8$ of FIG. 1 are (−15) and 0 volt respectively. Therefore, the difference of the source drive output voltage ΔV is 15 volt and smaller than the preset threshold voltage $V_T$ with 20 volt so that the bi-stable display frame is updated with the (−15) and 0 volt of the preset source drive output voltages respectively at the frames $F_9$ to $F_{10}$ in FIG. 3.

Figure 4:
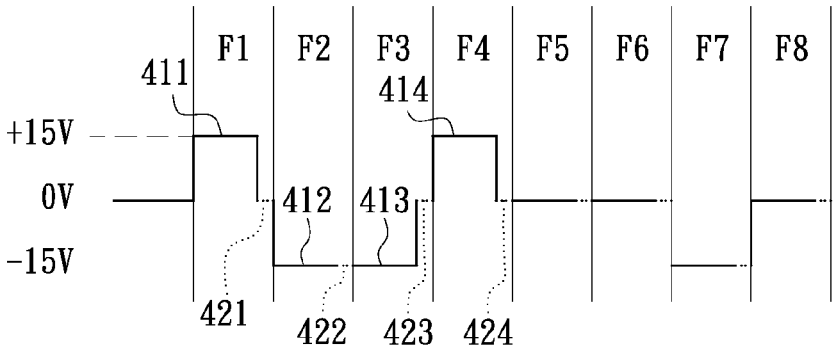
FIG. 4 is a schematic diagram of another embodiment of the source drive output voltage of the bi-stable display during an image updating period according to the invention.

In the embodiment, the dummy line is being as the transitional state. Please refer to FIG. 1 and FIG. 4, wherein FIG. 4 is a schematic diagram of another embodiment of the source drive output voltage of the bi-stable display during an image updating period according to the invention. The positive and negative high voltage levels $V_1$ and $V_2$ (not shown) of the adjacent frames $F_1$ and $F_2$ of FIG. 1 are (+15) and (−15) volt respectively and the preset threshold voltage $V_T$ is 20 volt. Therefore, the difference of the source drive output voltage ΔV is 30 volt and greater than the preset threshold voltage $V_T$ so that the transitional state is located at the dummy line behind the active scan line, and the parameter value includes the source drive output voltage with 0 volt corresponding to the dummy line. As the adjacent frames $F_1$ and $F_2$ of FIG. 1, the frame $F_1$ of FIG. 4 has the active scan line 411 and the dummy line 421 and the corresponding source drive output voltages are (+15) and 0 volt respectively. The frame $F_2$ of FIG. 4 has the active scan line 412 and the dummy line 422 and the corresponding source drive output voltages are (+15) and 0 volt respectively. Similarly, the positive and negative high voltage levels $V_1$ and $V_2$ (not shown) of the adjacent frames $F_3$ and $F_4$ of FIG. 1 are (+15) and (−15) volt respectively and the preset threshold voltage $V_T$ is 20 volt. Therefore, the difference of the source drive output voltage ΔV is 30 volt and greater than the preset threshold voltage $V_T$ so that the frame $F_3$ of FIG. 4 has the active scan line 413 and the dummy line 423 and the corresponding source drive output voltages are (−15) and 0 volt respectively. The frame $F_4$ of FIG. 4 has the active scan line 414 and the dummy line 424 and the corresponding source drive output voltages are (+15) and 0 volt respectively. Thus, the positive and negative high voltage levels that the difference value is equal or greater than the preset threshold voltage can not be switched directly without bad influence.

Figure 5:
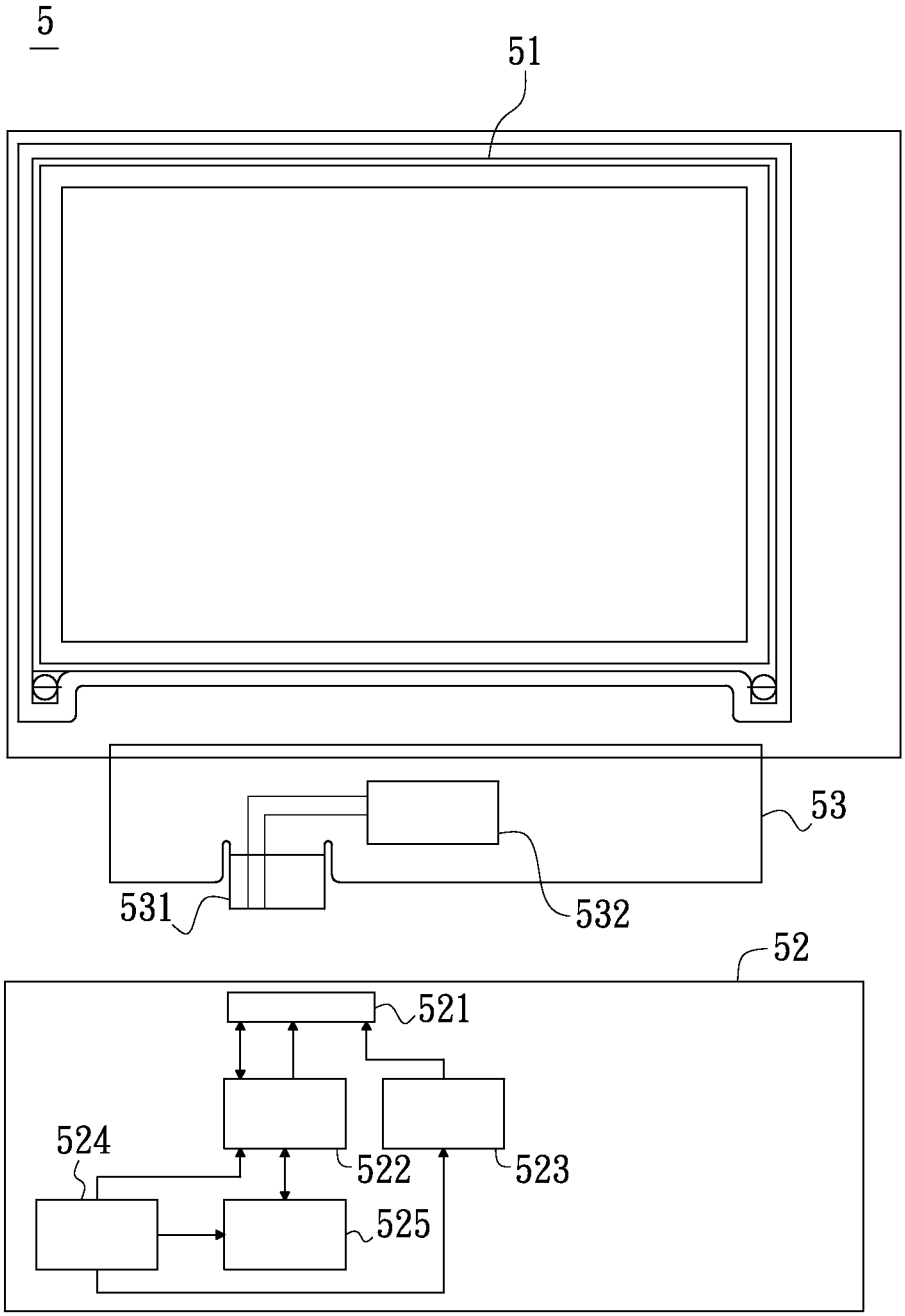
FIG. 5 is a block schematic diagram of an embodiment of the bi-stable display according to the invention.

Please refer to FIG. 5, it is a block schematic diagram of an embodiment of the bi-stable display according to the invention. In the embodiment of FIG. 5, the bi-stable display 5 comprises a bi-stable display panel 51, a drive control circuit board 52, and a middle interface circuit board 53. Wherein, the drive control circuit board 52 has a middle interface circuit board connector 521, a control chip 522, a panel power module 523, a system power supply module 524 and a microprocessor 525. The system power supply module 524 is electrically coupled to the control chip 522, the panel power module 523 and the microprocessor 525. The middle interface circuit board 53 is normally flexible printed circuit and electrically coupled to the middle interface circuit board connector 521 through a FPC Tail 531 of the middle interface circuit board 53. In the embodiment, the memory unit 532 is disposed on the middle interface circuit board 53 for storing the parameter value of the transitional state which can be read by the control chip 522. The parameter value is determined by a result of comparing the source driver output voltages of the image updating period and the preset threshold voltage, wherein the source driver output voltages could be the transitional state frame, the number of the dummy line or the source driver output voltage corresponding to each transitional state.

Figure 6:
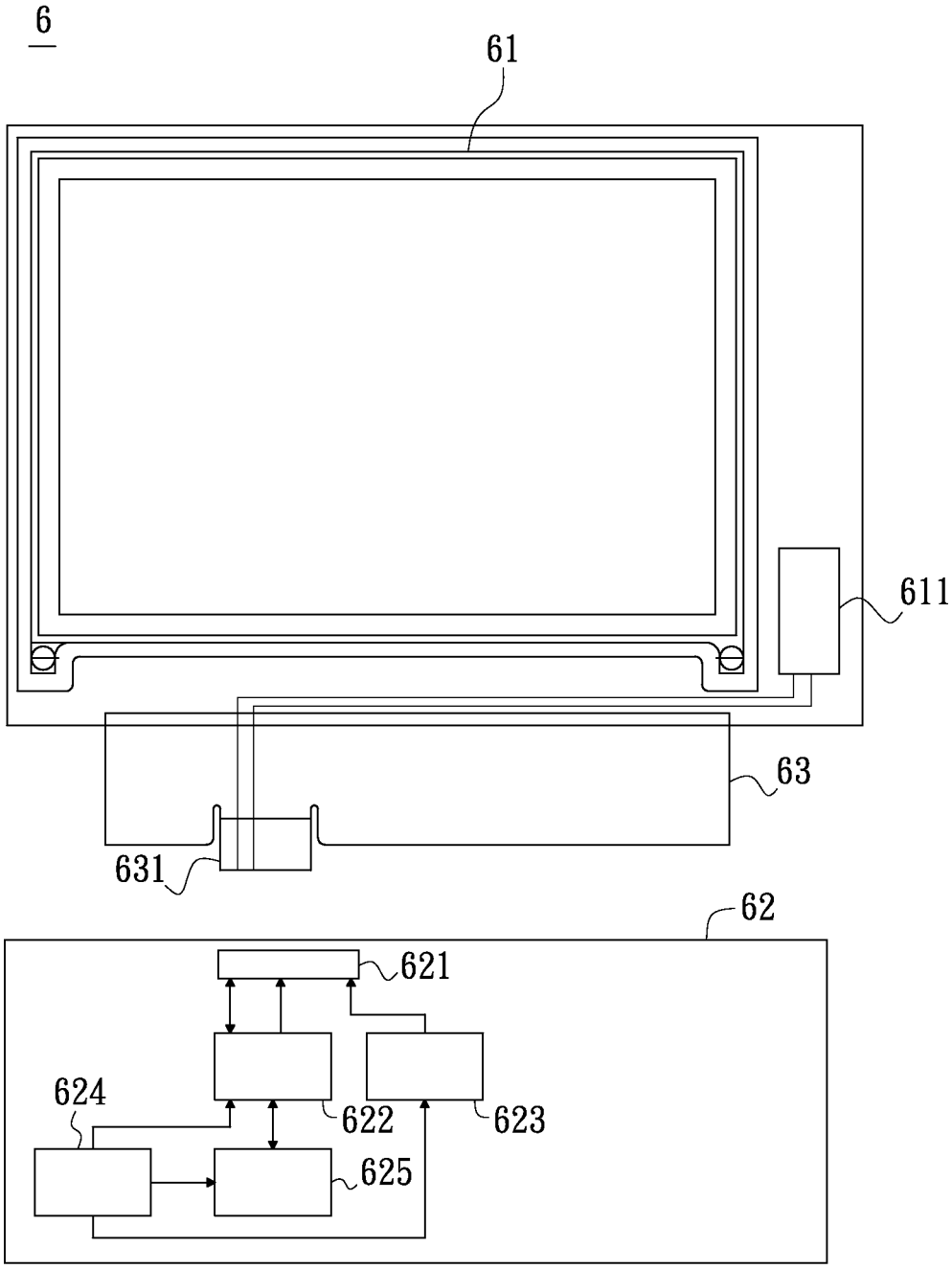
FIG. 6 is a block schematic diagram of another embodiment of the bi-stable display according to the invention.

Please refer to FIG. 6, it is a block schematic diagram of another embodiment of the bi-stable display according to the invention. In the embodiment of FIG. 6, the bi-stable display 6 comprises a bi-stable display panel 61, a drive control circuit board 62, and a middle interface circuit board 63. Wherein, the drive control circuit board 62 has a middle interface circuit board connector 621, a control chip 622, a panel power module 623, a system power supply module 624 and a microprocessor 625. The system power supply module 624 is electrically coupled to the control chip 622, the panel power module 623 and the microprocessor 625. The middle interface circuit board 63 is normally flexible printed circuit and electrically coupled to the middle interface circuit board connector 621 through a FPC Tail 631 of the middle interface circuit board 63. In the embodiment, the memory unit 611 is disposed on the bi-stable display panel 61. As a description of the embodiment in FIG. 5, the memory unit 611 also stores the parameter value of the transitional state which can be read by the control chip 622. Wherein, parameter value is determined by a result of comparing the source driver output voltages of the image updating period and the preset threshold voltage, and no more description here.

Figure 7:
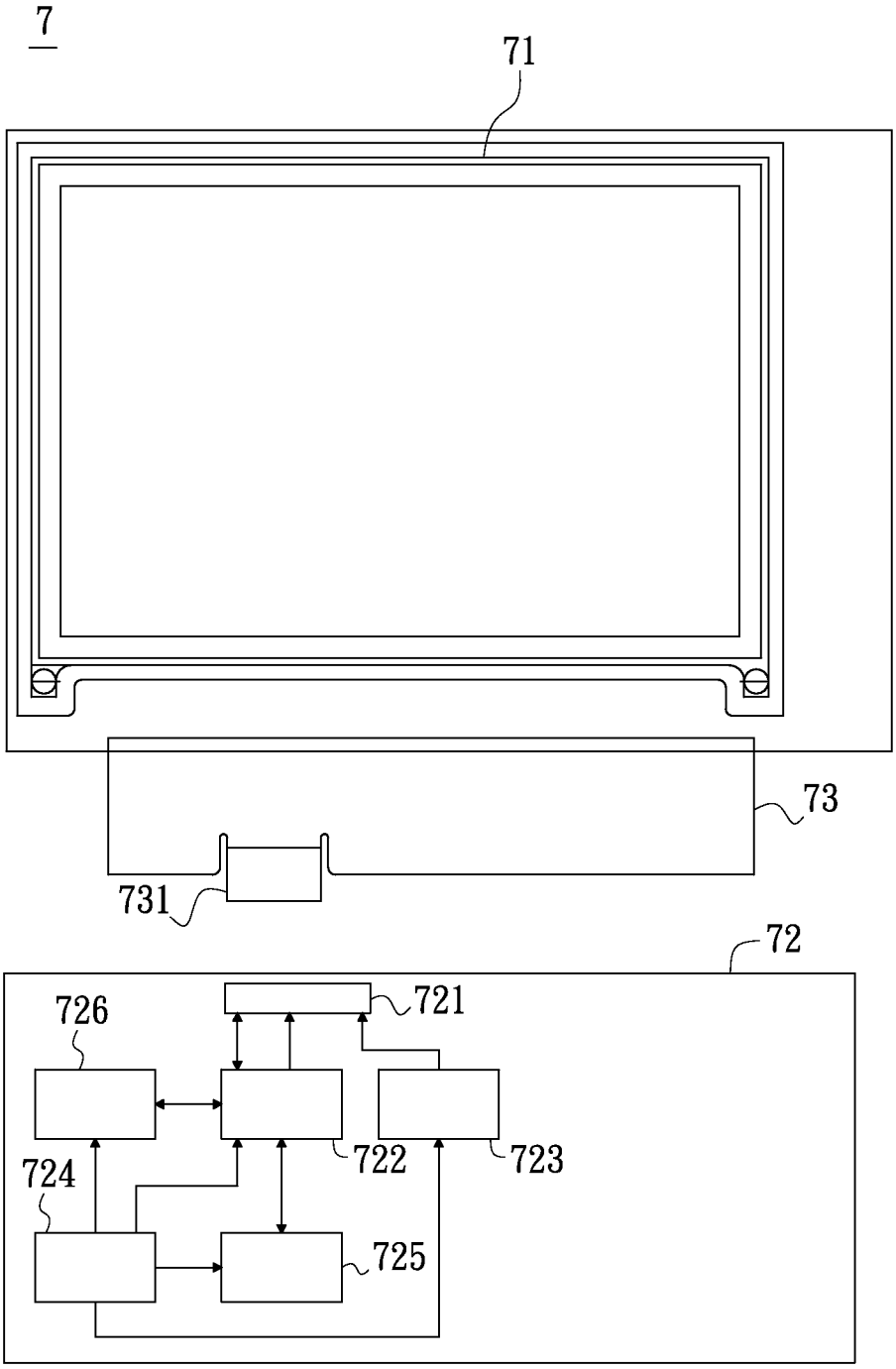
FIG. 7 is a block schematic diagram of other embodiment of the bi-stable display according to the invention.

Please refer to FIG. 7, it is a block schematic diagram of other embodiment of the bi-stable display according to the invention. In the embodiment of FIG. 7, the bi-stable display 7 comprises a bi-stable display panel 71, a drive control circuit board 72, and a middle interface circuit board 73. Wherein, the drive control circuit board 72 has a middle interface circuit board connector 721, a control chip 722, a panel power module 723, a system power supply module 724, a microprocessor 725 and a memory unit 726. The system power supply module 724 is electrically coupled to the control chip 722, the panel power module 723, the microprocessor 725 and the memory unit 726. The middle interface circuit board 73 is normally flexible printed circuit and electrically coupled to the middle interface circuit board connector 721 through a FPC Tail 731 of the middle interface circuit board 73. In the embodiment, the memory unit 726 is disposed on the drive control circuit board 72 for storing the parameter value of the transitional state which can be read by the control chip 722. The parameter value is determined by a result of comparing the source driver output voltages of the image updating period and the preset threshold voltage, and no more description here.

Figure 8:
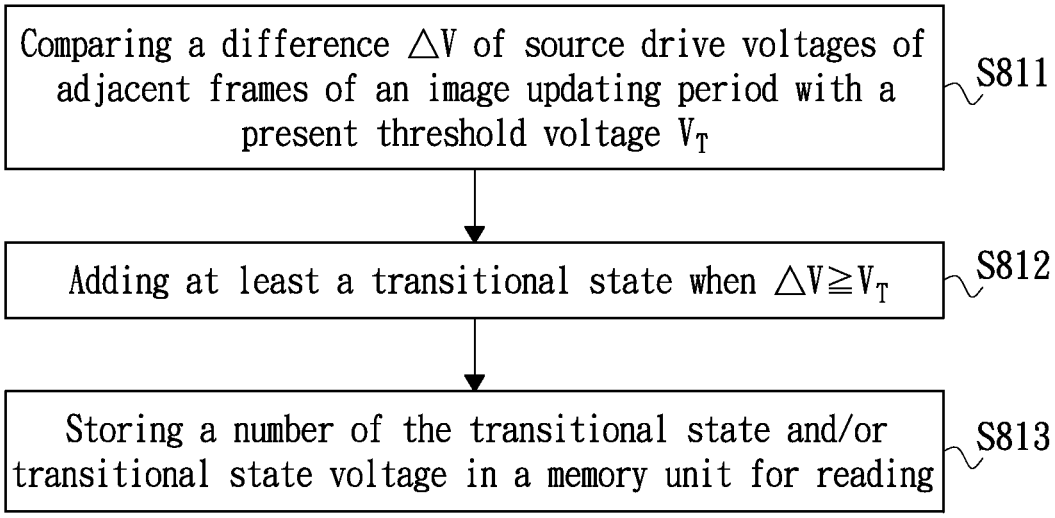
FIG. 8 is a flow chart diagram of an embodiment of the timing control method of the bi-stable display according to the invention.

Please refer to FIG. 8, it is a flow chart diagram of an embodiment of the timing control method of the bi-stable display according to the invention. In step 811, a difference ΔV(it is $|V_1-V_2|$) of source driver output voltages of adjacent frames are compared with a preset threshold voltage $V_T$ during an image updating period, i.e. the ΔV equal or greater than the $V_T$ is compared to determine whether switch amplitude of the voltage level is greater than the threshold voltage. In actual practice, the source driver output voltage and the threshold voltage can be recorded by using binary values, for example, 00 is presented as 0 volt, 01 is presented as (−15) volt, and 10 is presented as 15 volt. Therefore, the step S811 compares the difference ΔV of the source driver output voltages with the preset threshold voltage $V_T$, in fact it is equal to compare the difference of the preset binary values or the difference of the calculated source driver output voltages corresponding to the preset binary values with the preset threshold voltage. When the difference ΔV of the source driver output voltages is equal or greater than the preset threshold voltage $V_T$, a transitional state is added in step S812 at least. In one embodiment, the transitional state can be located between the adjacent frames or the dummy line behind the active scan line of the adjacent frames. Besides, a number of the transitional state and/or a voltage value of the transitional state are stored in the memory unit for reading.

In conclusion, in the bi-stable display, the frame updating method and the timing control method of the present invention, the blank frame or the dummy line is added to form the transitional state of the bi-stable display. Therefore, the levels of the source drive output voltages are changed in sequence by decreasing or increasing to eliminate signal interference, reduction of image quality resulted from switching between high voltage levels directly and rapidly and excessive power consumption.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A frame updating method of bi-stable display, comprising:

comparing a difference of source driver output voltages of adjacent frames of an image updating period with a preset threshold voltage;

determining a parameter value of each transitional state of the adjacent frames when the difference equal or greater than the preset threshold for controlling a level of each of the source driver output voltages; and adding a transitional state frame between the adjacent frames according to the parameter value;

wherein a first source driver output voltage of the transitional state frame is between the source driver output voltages of the adjacent frames.

2. The frame updating method of bi-stable display of claim 1, further comprising:

updating the bi-stable display frame with preset source driver output voltages of the adjacent frames when the difference equal or greater than the preset threshold.

3. The frame updating method of bi-stable display of claim 1, further comprising:

storing the parameter value in a memory unit for reading.

4. The frame updating method of bi-stable display of claim 3, wherein the memory unit is disposed on a bi-stable display panel, a driver control circuit board, or a middle interface circuit board, wherein the middle interface circuit board is coupled to the drive control circuit board.

5. A bi-stable display, comprising:

a bi-stable display panel;

a drive control circuit board including a middle interface circuit board connector, a control chip, a panel power module, a system power supply module and a microprocessor; and a memory unit for storing a parameter value of a transitional state being read by the control chip, wherein the parameter value is determined by a comparing result of comparing a difference of source driver output voltages of adjacent frames of an image updating period with a preset threshold voltage;

wherein a transitional state frame is added between the adjacent frames according to the parameter value and a first source driver output voltage of the transitional state frame is between the source driver output voltages of the adjacent frames.

6. The bi-stable display of claim 5, wherein the memory unit is disposed on the bi-stable display panel, the drive control circuit board, or the middle interface circuit board.

7. A timing control method of bi-stable display, comprising:

comparing a difference of source driver output voltages of adjacent frames of an image updating period with a preset threshold voltage; and adding at least a transitional state when the difference equal or greater than the preset threshold voltage for controlling a level of each of the source driver output voltages;

wherein the transitional state is located at a transitional state frame between the adjacent frames, and a parameter value of each transitional state of the adjacent frames is determined, the parameter value is a number of the transitional state or a value of the source driver output voltage corresponding to the transitional state, wherein a first source driver output voltage of the transitional state frame is between the source driver output voltages of the adjacent frames.

8. The timing control method of bi-stable display of claim 7, further comprising:

storing a number of the transitional state or a voltage value of the transitional state in a memory unit for reading.

9. A frame updating method of bi-stable display, comprising:

comparing a difference of source driver output voltages of adjacent frames of an image updating period with a preset threshold voltage;

determining a parameter value for the adjacent frames when the difference equal or greater than the preset threshold voltage for controlling a level of each of the source driver output voltages; and adding a number of transitional state frames between the adjacent frames according to the parameter value;

wherein first source driver output voltages of each of the transitional state frames are between the source driver output voltages of the adjacent frames.

* * * * *